US006910232B2

(12) United States Patent
Antunez

(10) Patent No.: US 6,910,232 B2
(45) Date of Patent: Jun. 28, 2005

(54) TOILET TANK VALVE

(76) Inventor: Bruce A. Antunez, 1143 Indian Springs, Glendora, CA (US) 91740

( * ) Notice: Subject to any disclaimer, the term of this patent is extended or adjusted under 35 U.S.C. 154(b) by 0 days.

(21) Appl. No.: 10/291,220

(22) Filed: Nov. 7, 2002

(65) Prior Publication Data

US 2004/0088782 A1 May 13, 2004

(51) Int. Cl.[7] ..... E03D 1/34

(52) U.S. Cl. ..... 4/378; 4/353; 4/380; 4/381; 4/382

(58) Field of Search ..... 4/378, 353, 380, 4/381, 382, 383, 387, 388, 389, 390, 391

(56) References Cited

U.S. PATENT DOCUMENTS

| | | | | | |
|---|---|---|---|---|---|
| 1,247,643 | A | | 11/1917 | Clifford | |
| D108,705 | S | | 3/1938 | Rosenthal | |
| 2,693,601 | A | | 11/1954 | Smith | |
| 3,086,218 | A | | 4/1963 | Gross | |
| 3,331,094 | A | | 7/1967 | Wustner | |
| D248,404 | S | | 7/1978 | Henry | |
| 4,145,775 | A | * | 3/1979 | Butler | 4/415 |
| 4,593,419 | A | * | 6/1986 | Derus | 4/324 |
| 4,656,677 | A | | 4/1987 | Miskiewicz | |
| D294,285 | S | | 2/1988 | Miskiewicz | |
| 4,945,578 | A | | 8/1990 | Jomha et al. | |
| 5,228,146 | A | | 7/1993 | Martell | |
| 5,329,647 | A | | 7/1994 | Condon | |
| 5,711,039 | A | * | 1/1998 | Mizrahi | 4/344 |
| 5,926,861 | A | * | 7/1999 | Frost | 4/378 |
| 6,336,229 | B1 | * | 1/2002 | Guo | 4/325 |

* cited by examiner

*Primary Examiner*—Henry Bennett
*Assistant Examiner*—Amanda Flynn
(74) *Attorney, Agent, or Firm*—Donald D. Mon

(57) ABSTRACT

A toilet tank flushing system including a ballcock valve for maintaining a storage level of water in the tank, a tank valve to release stored water on demand, and a linkage system which requires a reduced physical effort to initiate flushing. A hollow, open-ended closure for the tank valve enables a large cross-section area of discharge port to be used, and which can pass bowl refill water during the flushing sequence.

9 Claims, 4 Drawing Sheets

TOILET TANK VALVE

FIELD OF THE INVENTION

A fast-discharge, small volume toilet tank flush system.

BACKGROUND OF THE INVENTION

The advent of indoor plumbing and flush toilets, and decades of use and gradual improvement started with simple plug and flapper tank valves that were levered open, to remain open while a full tank emptied, and a ballcock valve which was open whenever the water level in the tank was below a storage level. While the ballcock valve was open, part of its total flow was diverted to refill the bowl at the same time the tank was being refilled. That procedure remains the same to this day for systems which use stored water to flush the toilet.

Nearly every year there has been an improvement in some part of the conventional systems. Tank valves have evolved into many forms of pivoted plates and floats. Ballcock valves have evolved from simple floats on a lever that pressed on a valve plate, to differential pressure actuated valves that require movement by the float of only a pin to open or close a very small bleed orifice for their control.

The floats themselves have evolved from copper spheres to foam bodies, to inverted cups of various shapes. Some were on lever arms. Others embraced an upright post. The ultimate limit on the water level was overflow into the bowl, through the same passage as was provided for the bowl refill.

The industry was greatly assisted by the development of plastic materials of construction. These materials need to resist pressure for a long time and also resist chemicals which would show up in the water from time to time. They enable the production of shapes and parts which could not economically be produced by metal casting and machinery processes.

As a disadvantage these new shapes and materials also enabled the production of sophisticated products in low-cost countries, to the disadvantage of domestic production. As a consequence, there has been significant incentive to invent and market even more sophisticated products hopefully made as inexpensively and perhaps better in the United States.

If it were merely a matter of making a same thing cheaper, there would be no merit in making changes. However, as the availability of these products (in part because of their low cost) improved, and along with population growth, the effluent from their systems also has increased to the extent that sewage systems designed for lesser loads are being overwhelmed.

The response to this problem has been to redefine how much water a toilet is permitted to discharge per flush. Low volume flush systems are now routinely required. Whereas in the past a large flush which depended on a sustained and relatively slow flow of water was the norm, now a much lesser amount of water is permitted for each flush cycle to do the same job. In order for this to happen a quick, high rate of flow of a low total volume of water is needed to wash away the waste.

Systems using direct flow from a pressure valve can often attend to this, but systems favored in less commercial places such as residences tend to use water tanks. It is an object of this invention to provide a water tank system with the capability of a sufficient and very rapid discharge of stored water.

As it happens, such improved systems involve related problems of their own. While each problem is relatively small, together they add up to a significant challenge. For example, to discharge a large volume quickly requires a large area discharge port and an equally large closure for it. The force required to lift the closure off of the discharge port valve seat is proportionally increased to the extent that it is difficult for an average person to operate.

Here, the ultimate problem is in the inefficiency of the trip lever used to lift the valve. The lever is inherently inefficient because the outside handle or knob available to the user is short, and the inside lever it turns is long. In itself it magnifies the force necessary to turn the handle, thereby compounding the problem.

It is an object of this invention to reduce the force needed to open the tank valve. In fact, without the improvements of this invention it may take as much as 10 pounds force on a 3 inch handle to open the valve. With the improvements of this invention, the required force to open a 3 inch diameter plug valve is only about 3 pounds. 10 pounds is too much force for many people, while 3 pounds is tolerable by almost everybody.

Another problem arises from the variations of dimensions of installed systems. To compensate for these, trip levers have often lifted a valve closure with flexible links such as chains or cables. This invention provides a lifting lever with a profile suitable for a wide range of dimensions for actuating the valve closure, and which does not require a flexible link. This is a savings in cost and, as will be seen, is also an improvement in function.

Conventional tank valves often rely on a pivoted valve closure which is costly and subject to later malfunction. It is an object of this invention to provide a single piece valve closure of surprisingly simple design—a unibody with a distinctive exterior, a passage entirely through the closure, with a lower guide and an upper end receptive of refill water, and which when open is a freely floating body without restraint to the tank structure.

This system is adapted to use with a conventional ballcock valve, and requires only a relatively small actuating force.

BRIEF DESCRIPTION OF THE INVENTION

This invention is adapted for use in a tank having a bottom and a peripheral sidewall to receive, store and discharge water to flush a toilet. A discharge port is formed through the bottom. A tank valve having a tank valve seal is fitted in the discharge port. This seal is horizontally disposed.

A tank valve closure is a hollow circularly-shaped body having an upper opening and a lower opening. It includes a reduced dimension lower guide loosely to guide the closure in the discharge port. A flared-out portion above the guide has a lower valving surface disposed and arranged to rest upon the valve seat to close it. A reduced-diameter neck rises from the flared-out portion, and carries an engagement means to be engaged by a lifting lever, eccentrically from the central axis of the closure.

A ballcock valve receives water which on demand supplies the tank with stored water and supplies the bowl with refill water. The ballcock valve is responsive to the water level in the tank. It is closed when the tank is filled to a desired storage level and open when the tank is to be refilled. Its bowl refill tube discharges into the neck of the tank valve closure.

Low profile installations frequently require that all of the mechanisms be in the tank, located above its bottom. For such installations, an optional riser may be fitted into the tank's discharge port and the valve seat is placed well above the bottom of the tank. This enables all parts of the system to be placed in the tank above the bottom, or within a spud just beneath the bottom.

The system is actuated by turning a handle which is journaled to the sidewall. When turned it rotates a lever linked to the closure. According to a preferred but optional feature of this invention, the lever is connected to the closure laterally off of its axis so that when it lifts the closure it first tilts it with little effort, which promptly reduces the differential pressure across the closure and thereby reduces the ultimate force needed to open the valve by further lifting the closure.

According to a preferred but optional feature of the invention the upper edge of the lifting lever is serrated along part of its length so that it can engage the closure reliably over a wide range of dimensions, and with the closure in a wide range of angular portions around its axis. This enables considerable freedom of movement and adaptability to dimensions of different installations.

As another preferred but optional feature of the invention, the handle is attached to the lift lever by a joinder which allows for universal adjustment of the angle between the two.

The above and other features of this invention will be fully understood from the following detailed description and the accompanying drawings, in which:

DETAILED DESCRIPTION OF THE INVENTION

Figure 1:
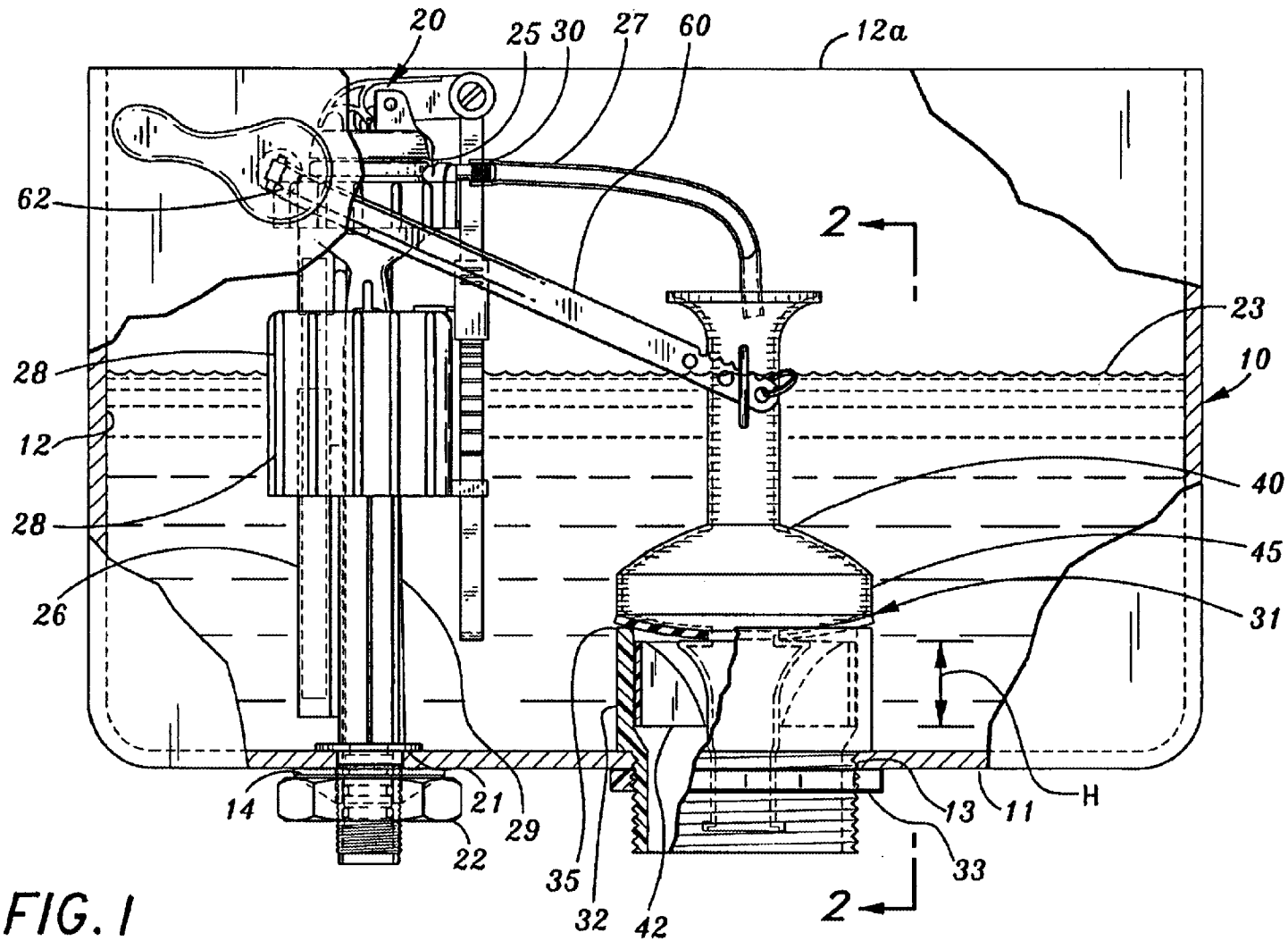
FIG. 1 is a side elevation of a toilet tank installation, partly in cutaway cross-section, showing the invention.
Figure 3:
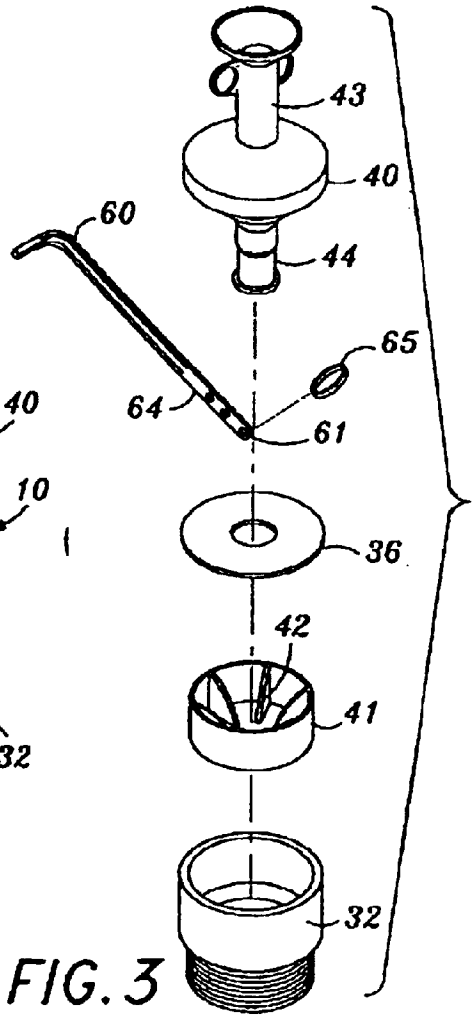
FIG. 3 is an exploded schematic view showing the lift lever and tank valve.

A toilet tank 10 has a bottom 11, a peripheral sidewall 12 and an open top 12*a*, which in use is covered by a removable lid (not shown). A central water discharge aperture 13 and an inlet aperture 14 are formed in the bottom of the tank.

A ballcock valve 20 is fitted in the inlet aperture by means of a typical spud 21 and nut 22. Any type of ballcock valve is suitable that provides the necessary functions of opening to flow when the water level 23 in the tank is below a predetermined elevation. At that time the valve workings 25 will supply water to the tank via a discharge tube 26, and to the toilet bowl through a bowl refill tube 27.

The illustrated valve is fully described in Antunez patent No. 6,244,292 which is incorporated herein in its entirety and made a part hereof by reference for its showing of the construction and operation of the valve workings.

A float 28 is wrapped partially around riser 29. Water under pressure is conveyed through the riser to the valve workings. The float follows the water level to actuate the workings via a linkage 30.

A tank valve 31 is fitted in water discharge aperture 13. A circular riser 32 is fitted to the tank bottom and held to it by a nut 33. The riser has a height H for a reason to be described below.

A tank valve seat 35 is formed atop riser 32. If the height of the riser were not necessary, the seat could be formed closer to the bottom.

A flexible washer 36 can be provided loosely, or can instead be attached to a closure 40 or to the valve seat so as in effect to form a valve seat, as preferred. A centering guide 41 comprises a group of axially and inwardly extending blades 42. Their innermost edges form a centering path. Guide 41 is fixed in the riser below the seat.

A closure 40 is a hollow structure with a substantially constant wall thickness. It has a dimension of axial length with an upper neck 43, a bottom guide 44, and an enlargement 45 between them. Although it is not immediately apparent, this closure will float when its upper end and lower end are vented at the same time and the closure is not seated on the seal.

The enlargement has a lower surface 46 which can abut and close on the seal (or washer). When it is seated, the lower end will be exposed to atmosphere in the outlet port (which leads to the toilet bowl), and the upper end will be above the water line and thereby also exposed to atmosphere. At this time there is a substantial net downward force on the closure which will keep it closed.

Here it will be observed that the bowl refill line discharges into the upper end of the closure, and water from it will flow directly through the closure to the bowl to refill it.

The closure is conveniently made by a blow-molding process. An engagement or ears 50, 51 are formed on the outside of the neck wall, to one side of the central axis 52 of the closure. Alternatively, the ears may be formed on a separate collar to be fitted around the neck. Actuation of the system begins with a full tank and the closure against the tank valve seal to close the tank valve.

A lift lever 60 has a free end 61, and a pivot end 62. The pivot end is attached to flush handle 63 through the peripheral wall, to both of which they are mounted. In order that the lever and handle can be adjusted relative to one another, the lever makes a press fit in a socket (not shown) in the lever. If desired, axial striations and grooves in the handle can be provide for a greater range of angular relationship between them. Alternatively the lever and socket may have smooth enlarging surface to permit universal adjustments between them.

A plurality of holes 64 are provided near the free end of the lever. A circlet 65 can be fitted into one of them after the free end has been inserted through one of the ears of the closure. The circlet will prevent the lever from separating from the closure. The plurality of holes 64 provides for different distances between the location of the ears and the pivot of the handle.

A plurality of serrations 66 are formed along the top of the lever where contact is to be made with the ears. In the course of use, the closure may turn around its axis for a few degrees, and also the distance from the ears to the handle may differ among installations. There will always be a serration in which the upper reach of an ear will lodge.

Figure 2A:
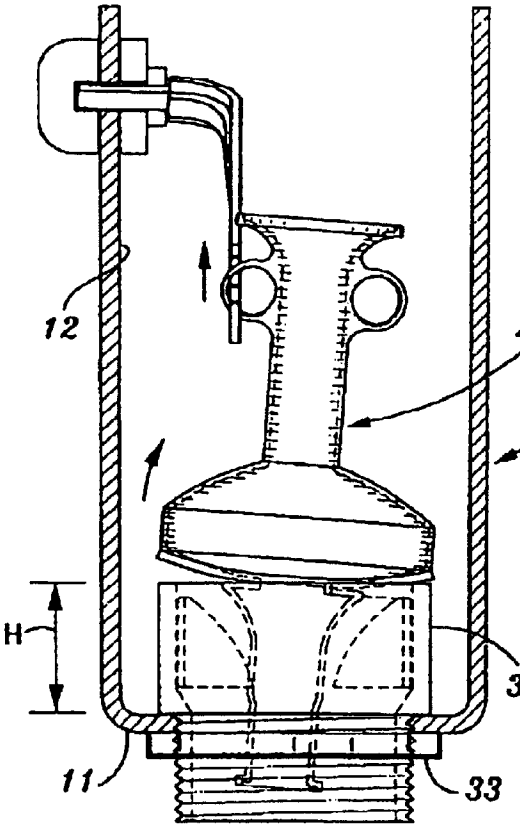
FIGS. 2 and 2A are cross-sections taken at line 2—2 in FIG. 1, showing the tank valve closed and first being opened, respectively.
Figure 2:
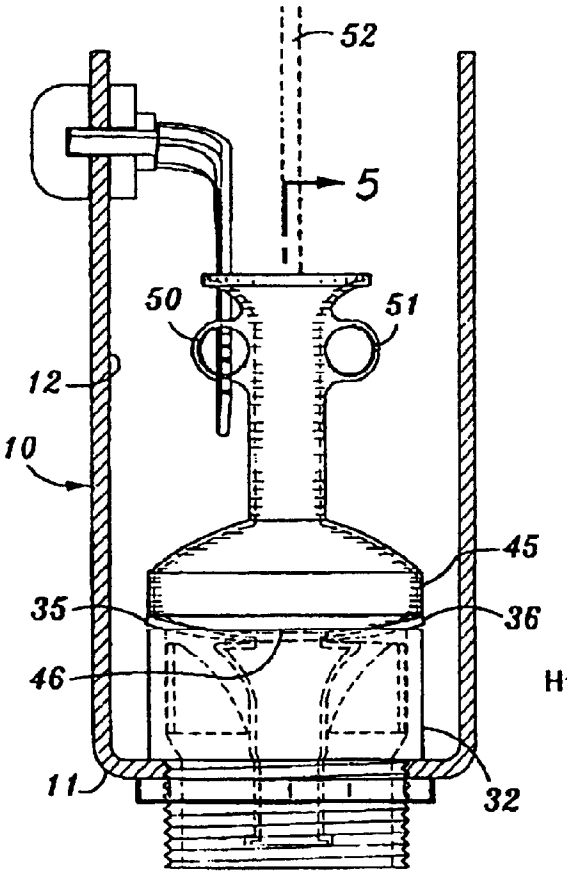
Figure 5:
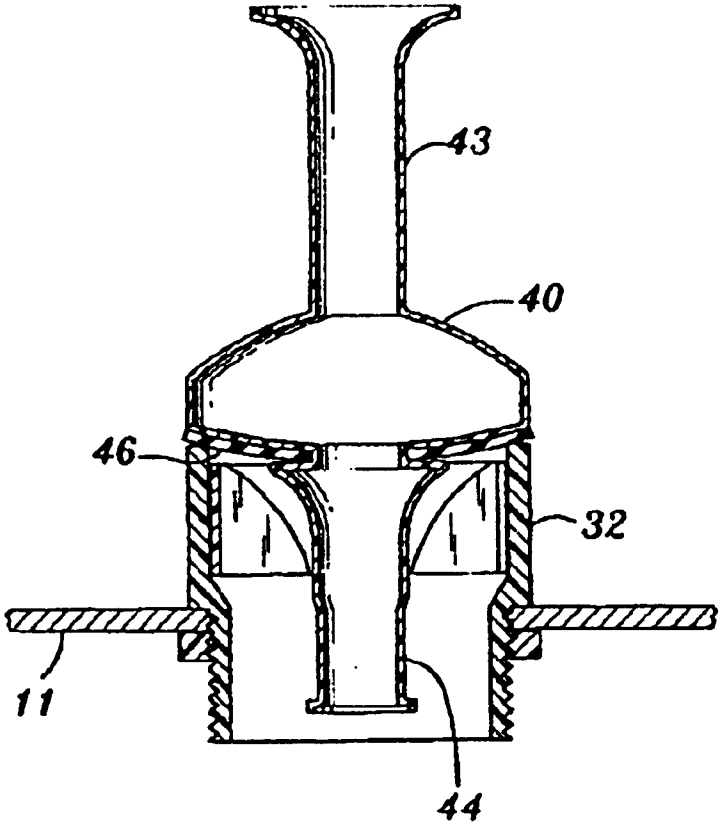
FIG. 5 is an axial cross-section of the tank valve.
Figure 4:
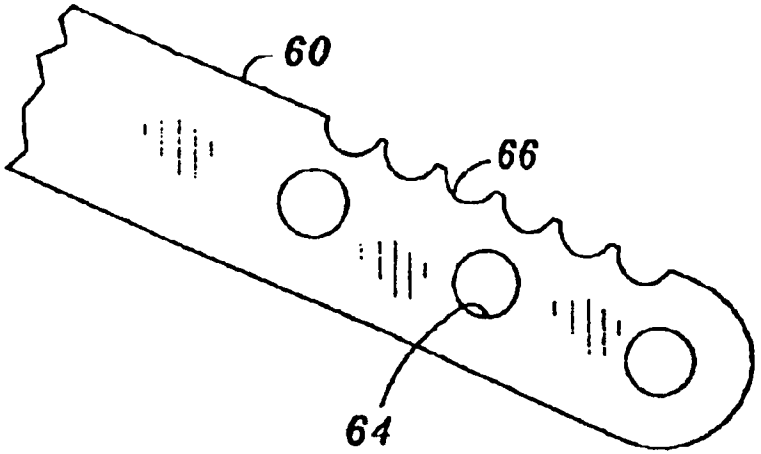
FIG. 4 is an enlarged fragment of the lift lever.
Figure 6:
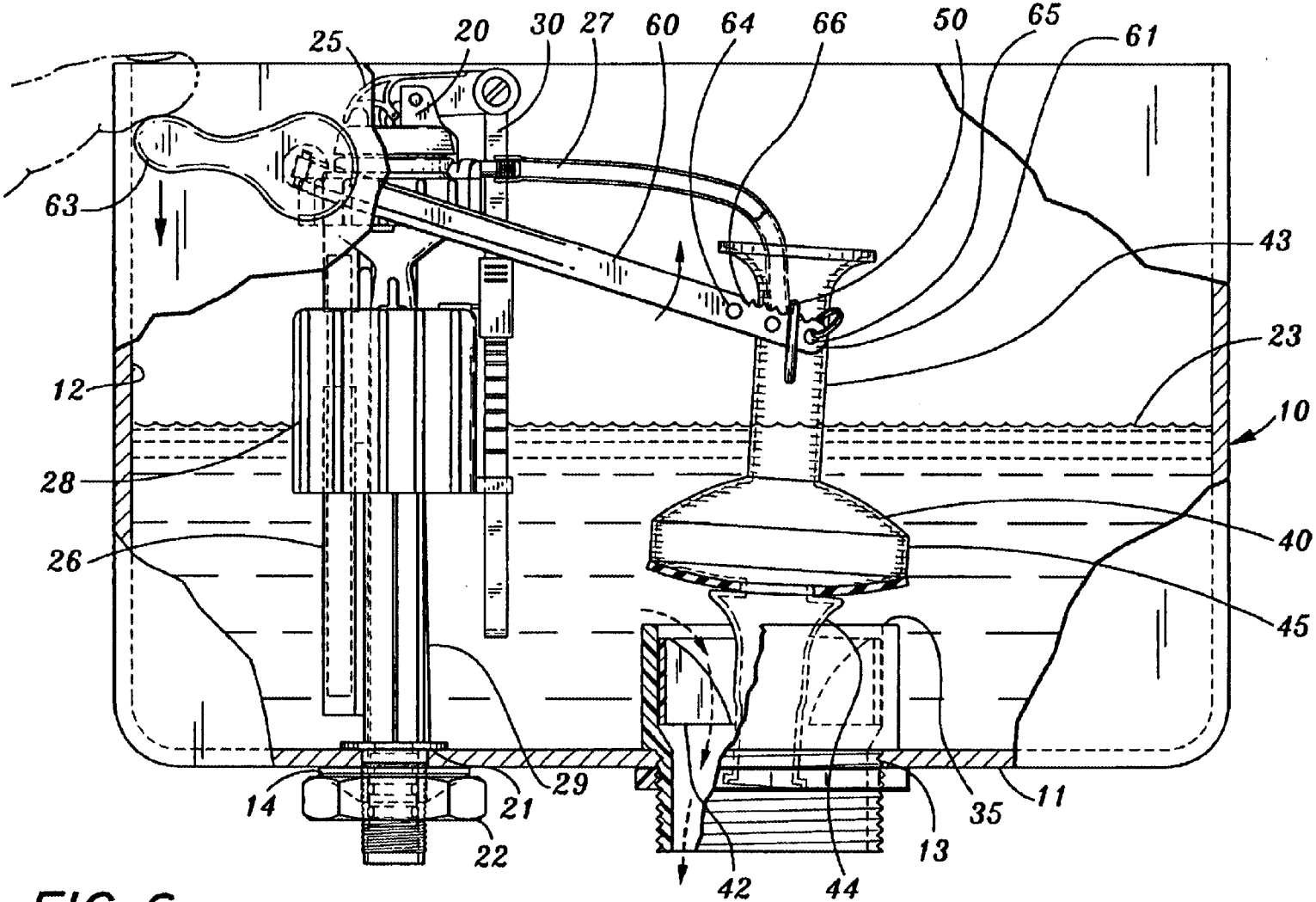
FIG. 6 is a side elevation similar to FIG. 1, showing the system open to flow.

The advantage of the off-center lift on the closure will be appreciated from an examination of FIGS. 2 and 2A. In FIG. 2, the closure is firmly seated on the seat, and is held by the pressure derived from the differential pressure on the top surface 70 of the closure which is exposed to water pressure, and the lower surface 46 which is exposed to atmosphere. This is a net heavy load to be lifted by an inefficient lever.

FIG. 2A shows the closure being lifted by the ear. Its first effect is to tilt, rather than axially to lift, the closure. This requires a markedly lesser force than a straight lift. "Cracking" the abutment as shown in FIG. 2A immediately releases the downward net force, and the closure can easily be raised the rest of the way.

After this is done, the float remains buoyant so long as water is flowing through the outlet port so as to expose the lower surface to atmospheric pressure. When flow stops, the closure will drop and close the outlet, and the net closure force is again exerted. The ballcock valve while still open will provide water directly to the tank and, through the closure to the bowl.

Attention is called to the stabilizing effect of the bottom guide 44 and the group of spaced apart blades 42. While permitting some tilting and sideward movement of the closure, they still keep the closure in line for operation.

In the embodiment shown in the drawings, there will always be water in the tank up to the level of the top of riser 32. This enables the mechanism to be contained entirely inside the tank and that portion of the riser which must extend below the bottom of the tank in any arrangement.

It will be noted that many of the advantages of this invention can be obtained by connecting the lever to the ears with a chain. This is another "operative engagement" of the lever and the closure. Therefore the use of a direct connection of the lever and the ears is not a limitation on the invention, but instead is a considerable advantage This invention is not to be limited by the embodiment shown in the drawings and described in the description, which is given by way of example and not of limitation, but only in accordance with the scope of the appended claims.

What is claimed is:

1. In combination:

a water storage tank having a bottom, a peripheral sidewall, a discharge port and a supply port in the bottom;

a ballcock valve mounted in the supply port, said ballcock valve including workings for passing or stopping flow of water, a float responsive to water level in the tank to which said workings are responsive, an inlet to the workings, and a tank refill line and a bowl refill line from the valve workings;

a valve seat around said discharge port;

a closure adapted to open and to close said valve seat, said closure comprising a hollow body having a central axis and a dimension of axial length, an upper neck, a lower guide, and an enlargement between said neck and said guide, said neck and guide being coaxial, a lower surface on said enlargement facing said valve seat so disposed and arranged as to fully engage and close said seat with said lower guide extending below said seat, the neck, guide, and enlargement forming a passage open from the upper end of the closure to its lower end, said refill line discharging into said upper neck;

an engagement on said upper neck laterally spaced from said central axis;

a handle rotatably mounted to said sidewall; and a rigid lever attached to said handle for rotation by said lever, said lever and engagement being operatively associated with one another, laterally spaced from said central axis, whereby actuation of said handle results in an off-axis upward pull on the engagement tending both to tilt and raise the closure off of the valve seat.

2. A combination according to claim 1 in which a guide is disposed in said discharge port to surround and limit the lateral movement of said lower guide to an acceptable sidewise movement.

3. A combination according to claim 1 in which said closure is a continuous body of revolution with a substantially uniform wall thickness.

4. A combination according to claim 3 in which said lower surface is a surface of revolution so disposed and arranged as to make a continuous circular in-plane seal with said valve seat.

5. A combination according to claim 4 in which said engagement comprises an ear carried on said upper neck.

6. A combination according to claim 5 in which said lever is inserted in said ear, whereby to engage said ear when said lever is raised.

7. A combination according to claim 6 in which said lever includes a top surface with a plurality of notches which can engage said ear.

8. A combination according to claim 7 in which a circlet is attached to said lever to prevent the lever from separating from the ear.

9. A combination according to claim 1 in which said handle and said lever are engaged for angular adjustment relative to one another.

* * * * *